United States Patent [19]

Benz et al.

[11] 4,299,504

[45] Nov. 10, 1981

[54] HIGH CAPACITY RIBBON CARTRIDGE WITH SURFACE DRIVE

[75] Inventors: Bernard D. Benz, Portola Valley; Edward M. Carlin, Jr., Milpitas; Thomas D. Gross, Los Altos, all of Calif.

[73] Assignee: Xerox Corporation, Stamford, Conn.

[21] Appl. No.: 165,513

[22] Filed: Jul. 3, 1980

[51] Int. Cl.[3] ..... B41J 32/00

[52] U.S. Cl. ..... 400/208; 400/196

[58] Field of Search ..... 400/194–196, 400/207, 208; 242/197–200

[56] References Cited

U.S. PATENT DOCUMENTS

| | | | |
|---|---|---|---|
| 3,356,202 | 12/1967 | Goff | 400/208 |
| 3,370,803 | 2/1968 | Newell | 242/55.12 |
| 3,520,495 | 7/1970 | Sotani | 242/199 X |
| 3,528,626 | 9/1970 | Bumb | 242/197 X |
| 3,584,944 | 6/1971 | Cook | 242/199 X |
| 3,593,945 | 7/1971 | Richardson | 242/192 |
| 3,604,549 | 9/1971 | Caudill et al. | 400/208 |
| 3,722,829 | 3/1973 | Arnoldussen | 242/199 |
| 3,908,931 | 9/1975 | Fundingsland | 242/199 |
| 3,960,342 | 6/1976 | Furst | 242/192 |
| 4,010,839 | 3/1977 | Guerrini et al. | 400/207 |
| 4,013,160 | 3/1977 | Colecchi et al. | 197/151 |
| 4,047,607 | 9/1977 | Willcox | 400/208 |
| 4,047,608 | 9/1977 | Willcox | 400/208 |
| 4,123,789 | 10/1978 | Shatavsky | 242/199 X |
| 4,147,439 | 4/1979 | Colecchi | 400/208 |

*Primary Examiner*—Paul T. Sewell
*Attorney, Agent, or Firm*—Serge Abend

[57] ABSTRACT

A ribbon cartridge for use in impact printers, typewriters or the like in which a supply spool and a take-up spool are enclosed in a housing with the center of each spool being supported for rotation and for floating movement along a guide path. A fixed center drive capstan imparts surface movement to the take-up spool which in turn imparts surface movement to the supply spool. A spring urges the surfaces of the spools together and the take-up spool against the drive capstan to effect the serial drive train.

13 Claims, 11 Drawing Figures

HIGH CAPACITY RIBBON CARTRIDGE WITH SURFACE DRIVE

This invention relates to a ribbon cartridge for use in impact printers and typewriters wherein the ribbon supply and take-up spools are mounted for rotation on floating centers and are biased against one another towards a drive element for surface drive of the spools.

Conventionally ribbon cartridges comprise a housing within which is disposed a supply of thin ribbon, of plastic film material such as Mylar bearing an ink coating on one surface, or of cloth into which is impregnated an ink solution. The ribbon originates upon a supply spool comprising a pancake-like pack of material wrapped around a hub. From the supply spools ribbon is unwound and fed out of the housing across an impact zone and then returned into the housing for collection upon a take-up hub to form the take-up spool as the ribbon pack builds up thereon. Both the supply and take-up hubs are mounted for rotation on fixed centers. Suitable driving elements associated with the cartridge move the ribbon along its path of travel. Most commonly, the drive mechanism rotates the take-up hub which draws the ribbon therearound thus exerting a tension on the ribbon of a sufficient magnitude to pull the ribbon along its entire path of travel and off the supply spool. In order to prevent free rotation of the supply spool, which will allow spillage therefrom and increase the probability of a ribbon jam, a drag force or torque is usually applied to the supply spool. This force or torque will further increase the tension on the useful span of ribbon, resulting in an increased probability of ribbon breakage. Furthermore, as the tension increases, the driving torque likewise increases and more power is needed to draw the ribbon along its path of travel.

During use, once the ribbon passes fully from the supply spool to the takeup spool, the cartridge is spent and will be discarded. It is then replaced with a fresh cartridge. Of course, premature replacement is also likely in the event of a ribbon jam or ribbon breakage. In these latter two cases, considerable wastage is possible, thus appreciably increasing the cost to the user.

Impact printer and typewriter ribbon cartridges are a high volume supply item in today's modern office where quality printed output is generated on word processing equipment. Therefore, it has become desirable to achieve improved cartridge designs which will decrease the supply cost to the user. Since the inked ribbon itself represents only a small portion of the cartridge costs, it should be apparent that one way to decrease the eventual cost to the user is to pack more ribbon into the housing. An improved design should also minimize spillage and other causes of jams and breakage which result in premature replacement.

The present invention provides an improved ribbon cartridge, for use in impact printers or typewriters, in which a supply spool and a take-up spool are enclosed in a housing with the center of each spool being supported for rotation and for floating movement along a guide path. A fixed center drive capstan is also located within the housing. The supply spool is urged against the take-up spool by means of a spring and the take-up spool is in turn loaded against the fixed center drive capstan for surface driving of the spools.

A number of advantages have been achieved by the arrangement of the improved ribbon cartridge. First, the floating center configuration allows the supply and take-up spools to share space within the housing as the ribbon is fed off of the former and onto the latter, resulting in a capability of housing substantially more ribbon than was heretofore possible with fixed center spools. Second, the new configuration provides a positive surface drive to the supply spool (directly from the take-up spool) resulting in lower and more consistent ribbon tension throughout the length of the ribbon. Third, the driving power requirements of the cartridge are decreased because of the reduced hold-back torque requirements of the supply spool. The resultant and more constant ribbon tension both statically and when under dynamic incremental motion allows thinner and thus less strong ribbon to be successfully utilized in this cartridge, thus yielding a further ribbon capacity advantage. And fourth, ribbon linear displacement (supply spool payout) is constant and proportional to the external drive angular displacement throughout the ribbon length because of the direct surface drive, in contrast to conventional take-up hub center drive systems wherein the ribbon is despooled at a variable rate, proportional to the take-up spool outer diameter.

A more complete understanding of the invention and its advantages will be clear from the following description and claims taken with the accompanying drawings, wherein FIG. 1 is a schematic representation of the improved ribbon cartridge of this invention showing the relationship of the supply spool and takeup spool at the beginning of ribbon usage;

Figure 1:
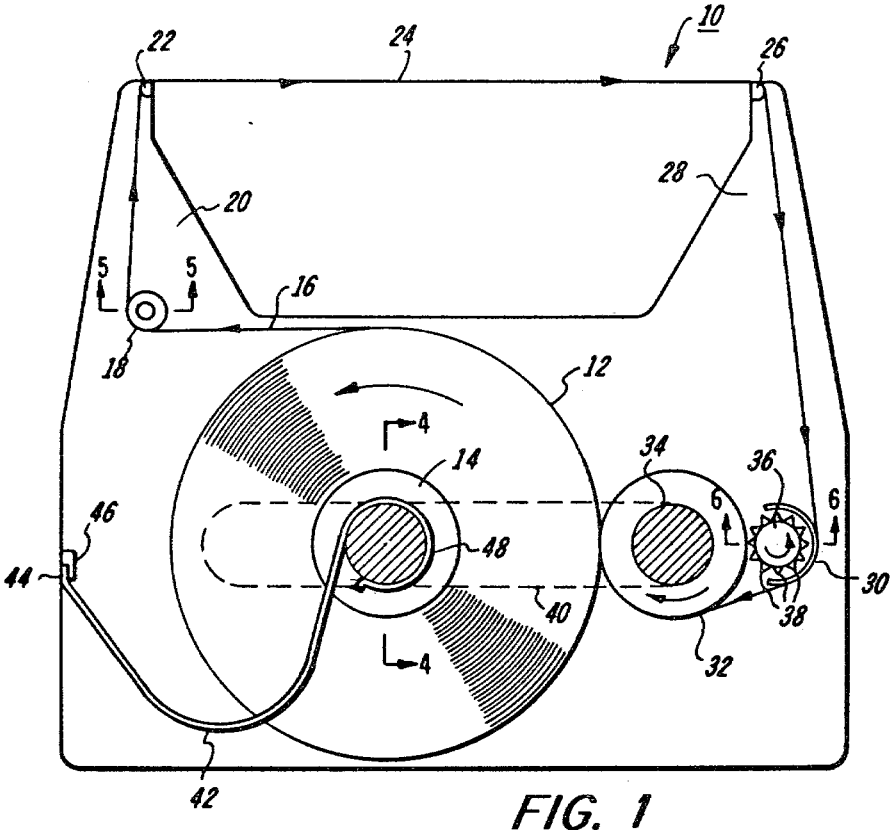

Turning now to the drawings, there is illustrated in FIG. 1 the ribbon cartridge 10 comprising a molded plastic housing made up of mating upper and lower housing halves within which is confined a supply spool 12 including a hub 14 on which is wound a supply of inked ribbon 16. The ribbon is unwound from spool 12 as the spool is rotated in a counterclockwise direction (as shown by the arrow) from which it passes over guide roller 18, is directed through outlet horn 20, over outlet guide bead 22, across impact zone 24 and back into the housing. As the ribbon enters the housing it passes over inlet guide bead 26, through inlet horn 28 and around arcuate guiding wall 30 to the take-up spool 32 comprising a hub 34 upon which the ribbon 16 is wound in a clockwise direction (as shown by the arrow).

Movement is imparted to the ribbon, for driving it along its path of travel through the system, by drive capstan 36 provided with circumferential teeth 38. The capstan is driven by external driving means which does not form part of the present invention, and is not shown. Of the three rotating members, viz. the supply spool 12, the take-up spool 32 and the drive capstan 36, only the drive capstan is mounted upon a fixed center, as will be described more fully hereinafter. It is possible in an alternative configuration to provide the fixed center capstan external to the cartridge. In such an embodiment, the capstan driving surface could contact the take-up spool periphery through an opening in the cartridge side wall. An arrangement of this type could result in a still smaller sized cartridge for a given capacity. Hubs 14 and 34 of the ribbon bearing spools 12 and 32 are constrained both for rotation and movement in a guiding track 40 formed in the housing. Although the single track 40 is shown to confine both hubs 14 and 34 for lateral movement in a straight line, it should be understood that numerous configurations of guiding arrangements, as dictated by the housing dimensions and design, are comprehended by this invention. A wire form compression spring 42 having one end 44 secured against movement by anchor 46 in the housing and the other end 48 wrapped about shaft extensions on hub 14 serves to bias floating supply spool 12 against floating take-up spool 32 which in turn is biased against fixed center drive capstan 36.

Rotation of the drive capstan 36 by a suitable external drive member disposed in the printer, will impart surface movement to the take-up spool 32 which in turn drives the supply spool 12. Thus, a length of ribbon will be unwound from the supply spool substantially equal in length to that which is wound onto the take-up spool. This ribbon driving arrangement is to be compared with conventional cartridge designs wherein the takeup spool is rotated by some external means and the ribbon is drawn along its entire path of travel by the tension thus imparted to it.

Figure 2:
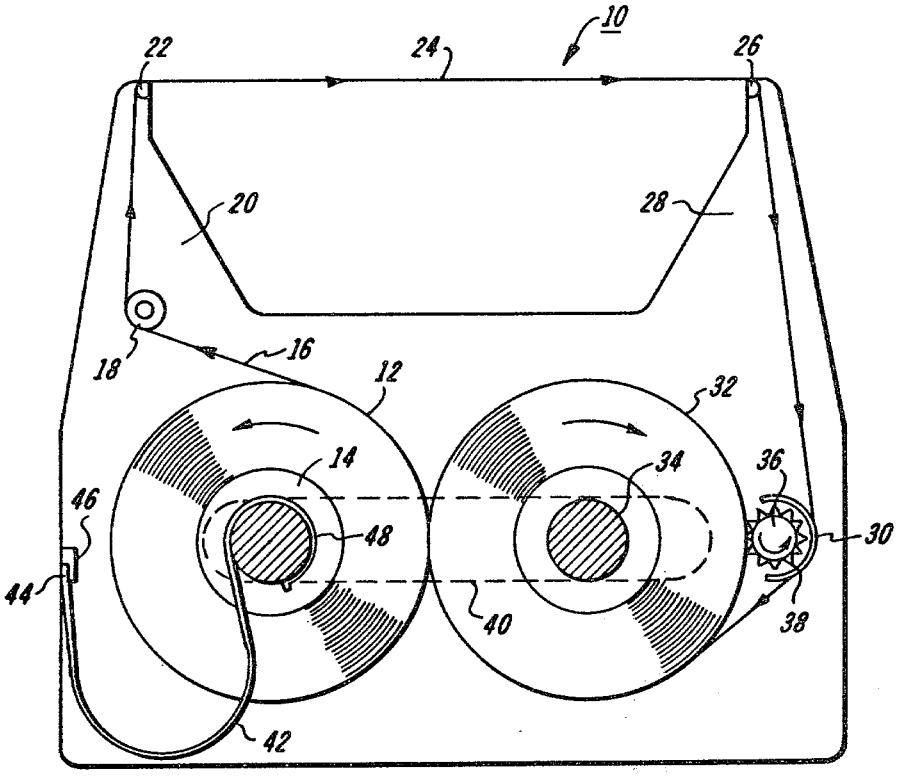
FIG. 2 is a view similar to that of FIG. 1 with the ribbon having been half used.

In FIG. 2 the supply spool 12 has been unwound by one half and the takeup spool 32 has appreciated by a like amount, causing the floating hubs 14 and 34 to move to the left, as illustrated. The spring 42 continues to urge the two spools and capstan into driving engagement.

Figure 3:
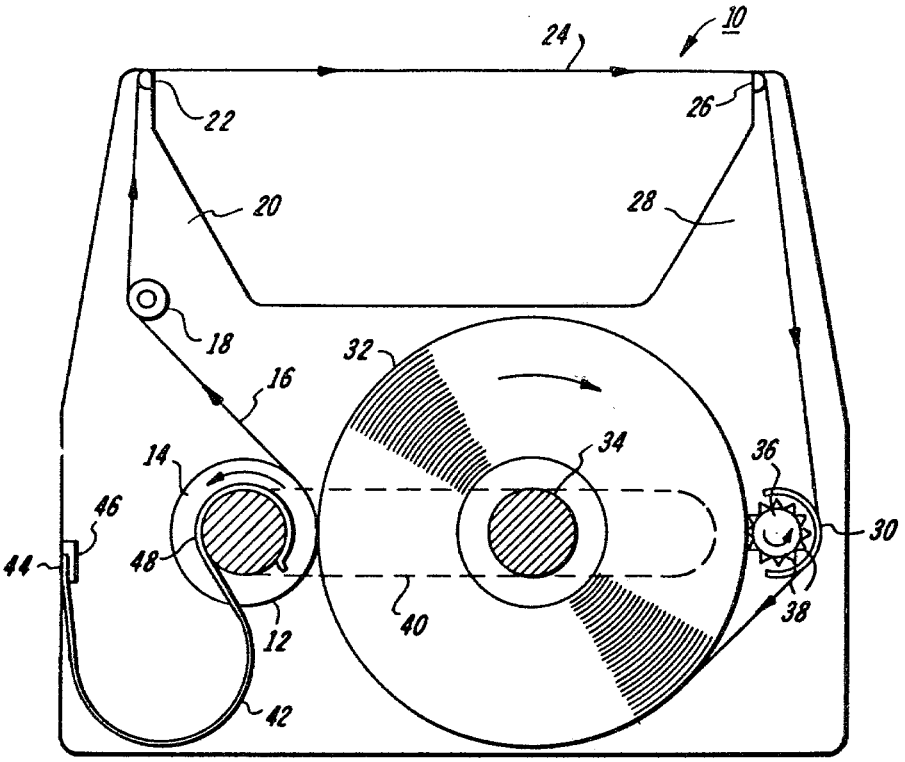
FIG. 3 is a view similar to that of FIGS. 1 and 2 with the ribbon substantially fully wound upon the take-up spool.

In FIG. 3 the supply spool has been substantially completely unwound down to the hub 14 and the take-up spool is substantially fully loaded with used ribbon. In this condition the cartridge 10 is exhausted and may be removed and discarded. It should be noted that the hubs 14 and 34 have moved completely to the left, as viewed in the drawing. By considering the spool positions in FIGS. 1, 2 and 3 simultaneously, it should be apparent that a major objective of this invention has been achieved, namely that the supply spool and take-up spool share space as the ribbon moves from one spool to the other. Thus, the overall cartridge package is capable of housing a considerably greater amount of ribbon than has previously been possible with the fixed center configurations of the conventional ribbon cartridges.

Some of the details of construction of the improved ribbon cartridge are shown more clearly in FIGS. 4 to 11. To enable a greater appreciation of the simplicity of assembly and operational benefits of the unique design these will now be described.

Figure 4:
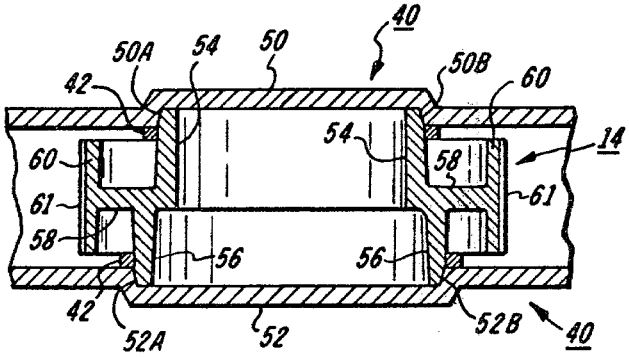
FIG. 4 is a sectional view taken substantially along line 4—4 of FIG. 1 showing the supply hub, with the ribbon removed, in relation to the housing track.

In FIG. 4 there is illustrated an enlarged sectional view of the supply hub 14 confined in housing guide track 40. Take-up hub 34 is of identical construction, therefore the description applies equally to both. However, it should be kept in mind that biasing wire form spring 42, shown in this Figure, acts only on the supply hub. The housing guide track 40 comprises elongate protrusions 50 and 52 (seen in cross-section) formed in the upper and lower housing halves, respectively, for providing rails (50*a*, 50*b*, 52*a*, 52*b*) upon which central axial hub extensions 54 and 56 ride. Extending radially outwardly from the central portion of the hub is a circumferential rib 58 which terminates in the cylindrical outer wall 60. The ribbon supply wrapped about the cylindrical wall 60 is substantially coextensive with the upper and lower extremities thereof and forms the supply spool "pancake" (not shown in FIG. 4). Since a single hub construction serves for both the supply and take-up spools, a toothed peripheral surface 61 is provided on the common hub configuration, as such is required on the take-up hub to cooperate with the teeth 38 on the drive capstan 36, as will be described.

Figure 5:
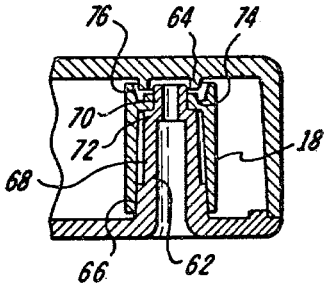
FIG. 5 is a sectional view taken substantially along line 5—5 of FIG. 1 showing the guide roller and the manner in which it is mounted in the housing.

It has already been described above that the ribbon unreeled from the supply spool passes to guide roller 18. FIG. 5 illustrates the mounting arrangement for the guide roller within the housing to ensure correct seating and self centering therein. A cylindrical stem 62, formed in the lower housing half, extends upwardly towards a short coaxial cylindrical boss 64 depending from the upper housing half. Stem 62 includes a large diameter base 66 which steps down to a smaller diameter body 68 and terminates in a still smaller diameter head 70. A shoulder 72 forms the transition between stem body 68 and stem head 70. The guide roller 18 is self seating when placed over the stem 62 when its shoulder 74, on the interior of the roller, rests upon the stem shoulder 72. Self-centering of the roller 18 is effected as the inner wall of the lower end of the roller rides upon stem base 66 and cylindrical boss 64 on the upper housing half seats loosely in a circular trough 76 formed in the upper end of roller 18. Suitable, low friction, surface-on-surface sliding is effected by the relatively small areas of contact and by the proper selection of materials. For example, the housing halves may be molded of polystyrene while the guide roller may be molded of Delrin.

Figure 6:
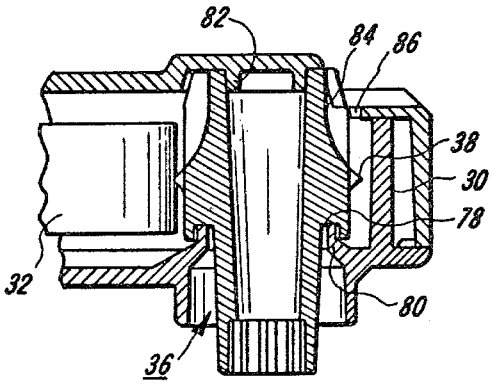
FIG. 6 is a sectional view taken substantially along line 6—6 of FIG. 1 showing the drive capstan and the manner in which it is mounted in the housing.
Figure 8:
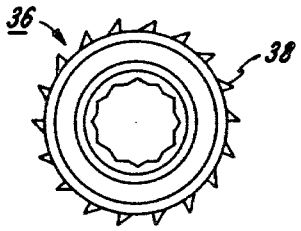
FIG. 8 is a bottom view of the drive capstan showing an internal drive arrangement therefor.
Figure 9:
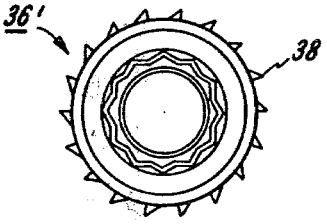
FIG. 9 is a bottom view of an alternate embodiment of the drive capstan showing an external drive arrangement therefor.
Figure 7:
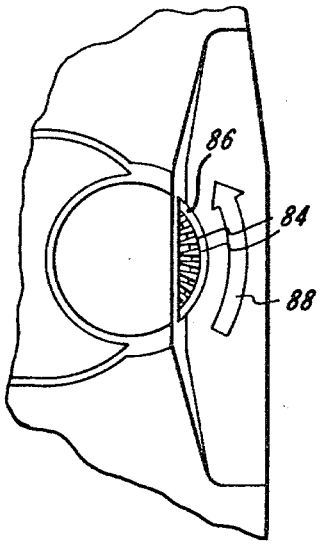
FIG. 7 is a partial plan view of the top of the housing showing how the drive capstan is manually accessed.
Figure 10:
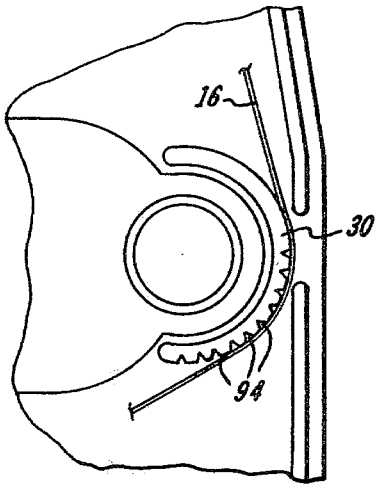
FIG. 10 is a partial plan view of the interior of the bottom half of the housing directly beneath the portion shown in FIG. 7, showing the ribbon guide wall.

FIGS. 6 through 9 relate to the drive capstan 36 which is shown in FIG. 6 to be seated within the housing for rotation. A circumferential trough 78 on the capstan accepts upwardly extending cylindrical bead 80 of the lower housing half while the upper end of the capstan receives cylindrical boss 82 extending downwardly from the upper housing half. Approximately centrally disposed, relative to the length of the cylindrical capstan, is a single row of outwardly extending sharp teeth 38. The teeth are raked as shown in FIGS. 8 and 9 for improved gripping and driving, which is accomplished by their biting into and through the several outer layers of spent ribbon being wrapped upon the take-up spool 32. Initially, as the ribbon is wound upon the empty take-up hub, there is insufficient ribbon pack to allow the capstan teeth 38 to bite, and thus to drive. Therefore, the hub has been provided with a toothed peripheral surface 61 (see FIG. 4) with which the capstan teeth 38 cooperate to effect a positive drive during the initial stages of ribbon take-up.

Often a manual advance mechanism is desired, such as for drawing taut any slack ribbon which might have resulted during shipment. There is herein provided a manual ribbon advancing arrangement comprising a plurality of circumferential, radially extending ribs 84 which extend through an arcuate window 86 in the upper housing half. If desired, the user may rotate the drive capstan by engaging the extending ribs 84 and move them in the direction shown by the molded in arrow 88. Window 86 serves a visual inspection function as well, since the drive capstan 36 may be seen to rotate during normal operation of the printer.

The drive coupling comprises an internal double overlapping hexagon as seen in FIGS. 6 and 8. An alternative embodiment of the capstan drive coupling is shown in FIG. 9 wherein there is disclosed an external double overlapping hexagon on drive capstan 36'. Thus, by merely inserting one or the other capstan configurations during assembly the ribbon cartridge may couple with one or another machine driving mechanism within the printer, which may incrementally advance ribbon in different displacements as required for the single strike drive for very high quality offset master preparation or photocomposing work, or the multi-strike drive such as is commonly used in the office environment.

As the ribbon 16 travels down the inlet horn 28 toward the take-up spool, it passes over the arcuate wall 30 which extends upwardly from the lower housing half. To prevent binding of the plastic ribbon substrate with the polystyrene wall a series of "vee" grooves 94 are provided in that portion of the wall, subject to extended contact (see FIG. 10), to reduce the surface area of contact and to allow the ribbon to slide more easily.

Figure 11:
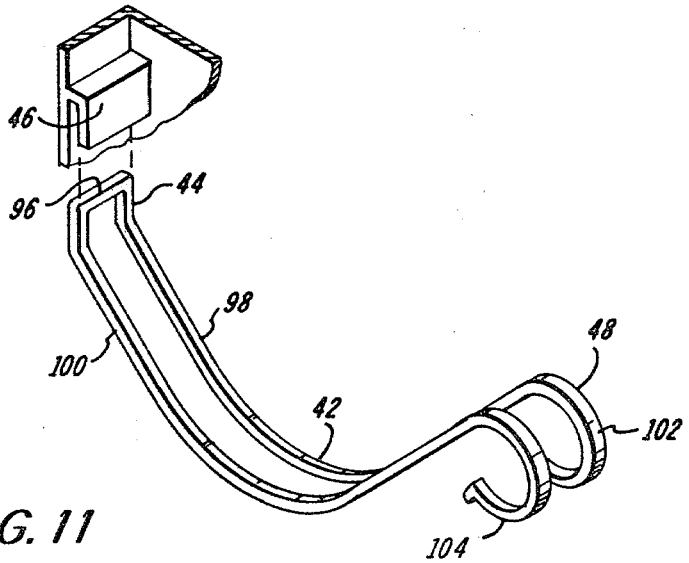
FIG. 11 is a perspective view of the wire-form spring used in the ribbon cartridge.

Wire form spring 42 is shown independently in FIG. 11. It comprises a transverse member 96 at anchoring end 44 from which extend legs 98 and 100. Each of the legs terminates in a wrap portion 102 and 104, respectively, which partially encircles the upper and lower axial hub extensions 54 and 56 of the supply spool (see FIG. 4). The wrap portions are formed with an inside diameter slightly smaller than the outside diameter of the hub extensions so as to exert a controlled hold-back torque on the supply spool resulting in a minute amount of slippage between the supply and take-up spools for establishing a nominal ribbon tension in the cartridge.

From the foregoing it should be appreciated that the unique ribbon cartridge of the present invention provides a substantial advance in the art. First, the supply and take-up spools share space as the ribbon moves from one to the other, thus allowing the overall cartridge dimensions to be considerably smaller than if the two spools had fixed centers. Second, it employs the surface drive of both the take-up and supply spools with the attendant advantage of lower and more consistent ribbon tension throughout the useful length of ribbon, and particularly in the impact zone. Third, a lower driving torque is needed to drive the system, allowing less power to drive the ribbon as compared with the conventional fixed center tension systems.

It should be understood that the present disclosure has been made only by way of example and that numerous changes in details of construction and the combination and arrangement of parts may be resorted to without departing from the true spirit and scope of the invention as hereinafter claimed.

What is claimed is:

1. A ribbon cartridge for use in printers, typewriters and the like including a housing having substantially planar opposed walls between which there is enclosed a supply spool, a take-up spool and a length of inked ribbon mounted upon said supply spool and extending in a path out of said housing and back into said housing to said take-up spool, said cartridge being characterized by comprising drive means in contact with the surface of said take-up spool for rotating said spool, said drive means having a fixed center about which it rotates, guide means in said housing for supporting said supply and take-up spools for rotation about their respective centers and for supporting each of said spools for movement, and means for urging said supply spool against said take-up spool and said takeup spool against said drive means.

2. The ribbon cartridge as defined in claim 1 characterized in that said guide means comprises a straight track within which said supply spool and said take-up spool are confined.

3. The ribbon cartridge as defined in claim 2 characterized in that the centers of said supply spool and said take-up spool lie upon a straight line and the center of said drive means also lies upon said line.

4. The ribbon cartridge as defined in claim 1 characterized in that said supply and take-up spools each include an axial extension and said guide means comprises a track on one of said opposed housing walls within which said axial extensions are disposed for restrained movement.

5. The ribbon cartridge as defined in claim 4 characterized in that said guide means comprises opposed tracks on each of said housing walls within which said axial extensions are disposed for movement.

6. The ribbon cartridge as defined in claim 1 characterized in that said means for urging comprises a spring having one end biased against said housing and its opposite end biased against said supply spool.

7. The ribbon cartridge defined in claim 5 characterized in that said means for urging comprises a spring in the form of an elongated wire element having one end anchored on said housing and its opposite end forming a wrap upon each of said axial extensions of said supply spool.

8. The ribbon cartridge defined in claim 1 characterized in that said drive means comprises a rotatable member having teeth extending outwardly therefrom for biting engagement with the periphery of said takeup spool to positively drive said take-up spool.

9. The ribbon cartridge defined in claim 8 characterized in that said teeth are raked for biting into the periphery of said take-up spool in the driving direction of rotation.

10. The ribbon cartridge defined in claim 8 characterized in that said rotatable member includes a ribbed peripheral portion and said housing includes an opening therein through which a segment of said ribbed peripheral portion extends for manual rotation of said driving member from outside of said cartridge.

11. The ribbon cartridge defined in claim 8 characterized in that said take-up spool includes a central hub upon which said ribbon is wound and the peripheral surface of said hub is notched to receive said teeth to positively drive said take-up spool during the initial stages of ribbon takeup.

12. The ribbon cartridge defined in claim 1 characterized in that said housing includes an internal arcuate wall disposed around a portion of said drive means over which said ribbon moves for guiding said ribbon to said take-up spool without interfering with said drive means.

13. The ribbon cartridge defined in claim 12 characterized in that said arcuate wall has a plurality of notches therein on the surface over which said ribbon moves, said notches extending transversely to the direction of ribbon movement.

* * * * *